US007370371B2

(12) United States Patent
Butterfas et al.

(10) Patent No.: US 7,370,371 B2
(45) Date of Patent: May 13, 2008

(54) ULTRA-LOW PROFILE TIE HOLDER

(76) Inventors: Ray Butterfas, 111 Huntington St., Huntington Beach, CA (US) 92648; Robert Palmer, 11825 E. 168th St., Artesia, CA (US) 90701

( * ) Notice: Subject to any disclaimer, the term of this patent is extended or adjusted under 35 U.S.C. 154(b) by 377 days.

(21) Appl. No.: 11/041,713

(22) Filed: Jan. 22, 2005

(65) Prior Publication Data

US 2006/0162044 A1 Jul. 27, 2006

(51) Int. Cl.
*A41D 25/04* (2006.01)

(52) U.S. Cl. ..... 2/145; 24/49.1

(58) Field of Classification Search ..... 2/144, 2/145, 146–151, 152.1, 153–157; 24/49.1, 24/54, 65, 66.1

See application file for complete search history.

(56) References Cited

U.S. PATENT DOCUMENTS 2,588,576 A * 3/1952 Roop et al. ..... 2/145
4,827,576 A * 5/1989 Prince, Jr. ..... 24/66.1
5,109,547 A * 5/1992 Abdallah ..... 2/145
5,216,785 A * 6/1993 Graef ..... 24/66.2
5,245,708 A * 9/1993 Campelia et al. ..... 2/145
5,315,713 A * 5/1994 Pileggi ..... 2/145
5,337,457 A * 8/1994 Chennault ..... 24/66.4
5,361,460 A * 11/1994 Pan ..... 24/66.4
5,375,301 A * 12/1994 Schindler ..... 24/66.4
5,715,538 A * 2/1998 Soll ..... 2/145
6,163,933 A * 12/2000 Smith ..... 24/66.2
6,954,943 B1 * 10/2005 Boyko ..... 2/156

* cited by examiner

*Primary Examiner*—Tejash Patel
(74) *Attorney, Agent, or Firm*—Michael McEntee

(57) ABSTRACT

The invention includes a necktie fastener system capable of restraining the bottom portion of the necktie close to the shirt of a wearer, and thereby controlling the entire necktie so that it won't fly in the wind, or while leaning over a table. The invention is for use when wearing a shirt having buttons located near the center of the front of the shirt. There is an H shape which is attached to the back of the apron of the necktie by simply hot ironing it. The H shape is relatively flexible allowing easy formation of the various necktie knots. Once the necktie has been tied and adjusted, the wearer inserts the a elongated placket under the horizontal bar and attaches the placket to two adjacent shirt buttons. The resulting combination slidably secures the end of the necktie nearest the bottom of the tie to stay near the shirt of the wearer. This gives control of the entire length of the tie from flying away in the wind or falling down when reaching over a table.

4 Claims, 3 Drawing Sheets

ULTRA-LOW PROFILE TIE HOLDER

CROSS REFERENCE AND REQUEST FOR PRIORITY

None

FEDERALLY SPONSORED RESEARCH

None

SEQUENCE LISTING ON PROGRAM

None

BACKGROUND OF THE INVENTION

1. Field of the Invention

The present invention teaches a new category of ultra-low profile, easily attached necktie holders which are capable of controlling the apron of the tie at a point near the belt line of the waist of the person wearing the necktie. The field of search for prior art concerning the invention includes both metal tie holders and non-metallic tie holders. The invention has equal application to both wide and narrow clip-on neckties as well as to neckties secured with a Windsor, Pratt, Shelby, or a Four-in-hand knot. The specific problems solved by the invention include the following: 1. The invention, as presently being produced, has a ultra-low profile of 0.064 inches (1.6 millimeters) resulting in the least bulge and least change in the natural drape of men's ties. The invention operates between the spaced buttons on the wearer's shirt rather than on top of the buttons. 2. The invention gives control over the lowest portion of the necktie, as it is worn, and thus achieves the best appearance and best control of the entire necktie. 3. The invention does the least damage the necktie during attachment of the invention to the tie. 4. The invention allows a close match of the modulus of elasticity of the invention's material and the typical men's necktie. 5. The invention permits steel rule die mass production of both parts of the invention. 6. The invention permits near infinite shelf-life both before sale and after installation on the necktie. 7. The invention also permits maximum automation of the process of installing the invention on neckties as they are manufactured because the invention can be made and transferred to the ties on wax paper transfer rolls. 8. With no change in tooling, the invention permits easy variation in color of the material so as to match the shirt and/or tie in order to better conceal the use of the invention by the person wearing the necktie. 9. The invention makes it practical to cut off the excess end of the tail of the necktie which would otherwise need to be tucked into the shirt or pants, yet to still control the necktie along nearly its entire length.

2. Description of the Prior Art

There are several existing categories of prior art. The first, and oldest category, involves mechanical devices made of metal or plastic used as gripping or clipping means to hold onto the parts of the wearer's shirt and the wearer's necktie. Representative of this category is U.S. Pat. No. 6,163,933, issued Dec. 26, 2000, to Albert Smith. The patent discloses a necktie retaining device which includes two parts: The first attached to the shirt and the second attaches mechanically to the tie. The first part includes a pair of opposed, laterally projecting barbs, and an eyelet, and the barbs pierce a portion of the tie. The second part is a retainer clip for connecting to either a button on a shirt or to the centerline of the shirt to secure the retainer clip to the shirt. The two parts connect together by means of the eyelet interfitting with part of the clip mounted on the shirt.

This patent is typical of "high profile" tie holders, characterized by requiring 0.375 inches (9 millimeters) or more to permit the metal clip to connect with the barbed metal tie clip. This patent is also representative of the use of piercing the back of the apron of the necktie in order to obtain sufficient mechanical connection to the tie. This patent is also typical of the bulge caused by the high profile of the tie holder. The high profile interferes with the drape of the tie.

Another representative of the metal tie clip category is U.S. Pat. No. 5,375,301, issued Dec. 27, 1994, to Gabriel Schindler. That patent discloses a tie clip having two clips. The first clip is spring biased to grip the designer label of the tie. The second clip grips the placket of a shirt. The "placket" of a shirt is the button edge of the user's shirt front. Schindler's patent '301 is useful for its detailed description of many variations of the "tie tack" and "tie bar" disclosed by prior art. But the device taught by '301 has the disadvantage of high profile, and the further disadvantage of high tensile spring wire wound to close the clips. Such wire always will tend to rust, and to later fail suddenly.

U.S. Pat. No. 5,361,460, issued Nov. 8, 1994, to Chih-Teng Pan discloses a device which is representative of another category of tie restraint devices involving chains as connectors between the tie and the user's shirt. The patent describes a tie clip mounted behind a tie. There is a clip formed by bending metal into a outer plate and an inner plate. Two chains are sewed to the back side of the tie. The chains attach to two ends of the metal clip. The clip is attached to to a front opening of the user's shirt. This category of tie clips has every failing which the present invention overcomes. The category has a high profile clip on the shirt, as opposed to the present invention which has a ultra-low profile of 0.064 inches (1.6 millimeters) resulting in the least bulge and least change in the natural drape of men's ties. 2. The chain category does not give control over the lowest portion of the tie, as it is worn. Indeed, the purpose of the chain is to allow considerable looseness of the tie. 3. The chain category requires the chain to be sewed in two places to the tie. Thus the tie is damaged during attachment of the chain in the sense that stitches will loosen and fail over time simply due to the thousands of vibrations the tie undergoes throughout each day of use. 4. The chain category tends to deform the tie because it pulls at the tie in two places, causing it to curl in an unsightly manner. This is particularly a problem with wider ties. 5. The chain category requires expensive steel punch and forming dies to mass produce the parts, which must then be laboriously hand assembled in jigs. 6. The chain category requires metal parts, and thus has a limited shelf-life both before sale and after installation on the tie because the metal parts will tarnish over time. 7. The chain category requires several production lines for the manufacture of the different parts, and then laborious assembly. The use of automation using transfer rolls is precluded by the hand work of sewing the chains to the tie. 8. The chain category does not permit ease of variation in color to match the shirt and/or tie in order to better conceal the use of the invention by the person wearing the tie. 9. The chain category does not permit the excess end of the portion of the tie to be cut off. Instead, the chain category requires considerable precision is tying the tie to make both ends of the tie come to a similar length in front of the user's shirt.

A third category of tie holder is represented by U.S. Pat. No. 5,315,713, issued May 31, 1994, to Vincent Pileggi.

This involves attachment to one or more buttons of the shirt of the wearer of some device which in turn controls the position of the necktie. Quoting the Pileggi patent, from Column 4, line 67: "In this embodiement, the tie restraining apparatus of the [Pileggi] invention includes a tail attachment means in the form of a lower attachment loop 24 and an upper attachment loop 26. Each of the loops 24, 26 are attached to the back 18 of the tie apron in such a manner that the tail 14 can be easily slid down through them in the manner shown. As is explained below, the tail attachment means of the [Pileggi] invention can take any suitable form and may be either permanently or temporarily attach the the back 18 of the apron 12."

The Pileggi patent continues, "The loops 24, 26 of this embodiment of the [Pileggi] invention are formed from a flexible cloth material, preferably similar or identical to the tie in texture and color. These loops should be attached far enough apart to comfortably span at least two buttons 28 on a dress shirt. . . . "

The Pileggi patent continues, at column 5, line 63: "A horizontal member 32 is provided with one or more button holes 34a, 34b adapted to attach to one of the buttons 28 on the wearer's shirt. Once the tie is tied and properly adjusted, the wearer then slides the tail 14 through upper loop 26. At this stage, the horizontal member 32 is slid onto the tail 14, positioned immediately below the upper loop 26, and the tail 14 is then attached through the lower loop 24 to secure the horizontal member 32 intermediate the ends of the tail 14. In this manner, the horizontal member is slidably mounted to tail 14 between the two loops 24, 26, permitting the restraint apparatus 30 to self-adjust.

Pileggi then describes horizontal member 32 to be, in so many words, a fabric sleeve through which the tail of the necktie passes. The sleeve has one or more button holes which, somehow, despite it being a sleeve, is buttoned onto a shirt. The tail 14, passes through the sleeve. Pileggi then describes at column 6, line 63, "To achieve far better operation of the [Pileggi] invention, it is preferred that the horizontal member 32 and/or the tail 14 of the tie is treated with a stiffener to decrease the tendency of the horizontal member to snag along the tail. Although the stiffener may take any form, such as starch or plastic coating of the tie, preferably such stiffener comprises a fusion cloth, . . . "

Pileggi then describes a clip shown in FIG. 4 of Pileggi's patent. That figure discloses the need to sew the clip to the tie in four places. The clip is described to be 1¾ inches (about 40 millimeters) by 1 inch (25.4 millimeters) and has "removable anchoring means (e.g. alligator clips)." Apparently this clip is utilized in place of loops 24 and 26.

Summarizing the Pileggi device: 1. A button hole on the shirt has a sleeve attached to it. 2. Through the sleeve passes the "tail" of the tie. The tail of the tie in turn is secured to the back of the apron of the tie through two additional loops. Those additional loops apparently are sewed to the back of the apron of the tie, and in place of the loops might be a plastic or metal clip which is sewed in four places to the tie.

Viewing the Pileggi device in light of the requirements of tying a "Four-in-hand" knot, or a "Pratt" or "Shelby knot, or a "Windsor" knot, in each case, it is not clear from the Pileggi patent how one gets the 1¾ inch wide clips 24, 26 through the knot, without considerable difficulty. Indeed, the Pileggi device inherently has the ":widest" profile of all the tie restraining devices. It also requires the greatest amount of skilled work to be done to install it.

Another representative of this category of necktie restraints involving attachment of part of the device to a button on the shirt of the wearer is shown in U.S. Pat. No. 5,109,547 issued on May 5, 1992, to Iman 'al-Amin Abdallah. Like the Pileggi device, there is a sleeve 12 shown in FIG. 2 of the '547 patent. The sleeve has a button hole to secure the sleeve to the wearer's shirt. But then, a tough plastic part, number 11, fits through the sleeve and attaches to the tie by means of sewing or by pressure sensitive strip 17. A major disadvantage of of the device shown in patent '547 is that the apron of the necktie becomes stiffened by the tough plastic part 11 in a way which affects the drape of the tie. As with the Pileggi device, the presence of the tough plastic part 11 greatly interferes with the ease with which the various necktie knots can be formed accurately and quickly by the wearer. Plus, the '547 device has a high profile, both in thickness of the plastic part 11, and in the stacking on the button, and then the sleeve on top of the button, and then the tough plastic part 11, and then the otherside of the sleeve. Finally, there is a real risk that the sleeve 12 will become stuck when it is inevitably wedged against the threads through holes 14 shown in FIG. 2 of '547, or wedged against the stickum 16 shown in FIG. 3 of '547.

Another representative of this category of necktie restraints attached to buttons on the wearer's shirt is shown in U.S. Pat. No. 5,216,785 issued on Jun. 8, 1993, to John Graef. Paraphrasing the abstract of that patent, '785 teaches a tie fastener for securing a necktie to a shirt which includes three strips of flexible material joined together at one end. Each strip is identical to the others. An inner strip is buttoned to a shirt and an outer strip is fed through the loop-label of the tie. An intermediate strip is interposed between the inner and outer strips and serves to cover a shirt button and prevent the loop-label from catching on the button. The Graef patent thereby limits itself to the position of the loop-label on the back of the apron of the tie. Typically, this is too high up to control the movement of the apron of the tie near the belt line of the wearer. It thus does not accomplish what the present invention accomplishes.

Another representative of this category of tie holder is U.S. Pat. No. 5,337,457 issued Aug. 16, 1994, to Kenneth Chennault. This patent appears to have expired for failure to pay maintenance fees. The Abstract of Patent '457 discloses "A neckware anchoring device (10) for retaining neckties (23) and the like in their intended position along the front portion of the wearer's garment (12). The anchoring device is received tie loop (22) and attaches to the button threads of selected buttons (24 and 26) on the shirt or bouse of the wearer. The device (10) engages the button threads by sliding behind the button without the need for inserting the button through a button hole. The device (10) is easily installed and removed by the wearer." FIG. 2 shows the tough plastic structure which functions as a dual clip. As with the Graef device in '785 described above, the use of the "tie loop" or as Graef describes it, the "label-loop," controls only the middle and upper portion of the apron of the tie and does not control the bottom of the tie, nearest the belt line. Thus, '785 does not accomplish a central goal of the present invention.

SUMMARY OF THE INVENTION

The invention includes a necktie fastener system capable of restraining the bottom portion of the necktie close to the shirt of a wearer, and thereby control the entire necktie so that it won't fly in the wind, nor will it sag into a bowl of soup while the wearer leans over a table. The invention is for use when one is wearing a shirt having buttons located near the center of the front of the shirt. There is an H shape which is attached to the back of the apron of the necktie by simply hot ironing it. The H shape is flexible, thus allowing easy formation of the various necktie knots. Once the necktie has been tied and adjusted, the wearer inserts the elongated placket under the horizontal bar and attaches the placket to two adjacent shirt buttons. The resulting combination slidably secures the end of the necktie nearest the bottom of the tie to stay near the shirt of the wearer. This gives control of the entire length of the tie from flying away in the wind or falling down when reaching over a table.

BRIEF DESCRIPTION OF THE DRAWINGS

FIG. 3 is of the adhesive side of the fabric which will form the H.

FIG. 4 shows the cross bar formed by folding adhesive coated surface 61 onto adhesive coated surface 63 and after activation of the adhesive by hot ironing to form glue line 64.

DETAILED DESCRIPTION OF THE PREFERRED EMBODIMENTS

Figure 1:
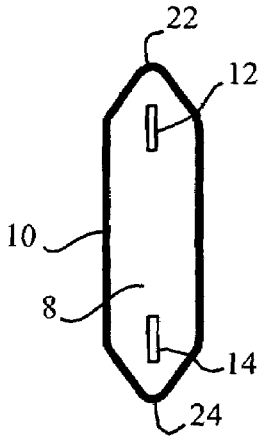
FIG. 1 is a plan view showing the top of a placket.

FIG. 1 is a plan view showing the top of the placket 10 as it may be produced in mass production utilizing steel rule dies. Placket 10 has formed along the longitudinal axis of the placket at least two button hole slits 12 and 14 as shown. The placket 10 is cut from flat material. One such material is cotton twill. Other types could be paper, cardboard, plastic film or sheet, leather, or the material used for ties or shirts. The flat material has an upper surface 8 and a lower surface 9, both of have a relatively smooth, low friction finish with no adhesive. Said placket has a longitudinal axis between a first end 22 and a second end 24. The distance between the two ends 22 and 24 is a pre-determined length and the typical length is 4¾ inches (about 116 millimeters). The placket 10 has a predetermined width, typically 1 3/16 inches (about 28 millimeters). The button slits 12, 14 are spaced at a pre-determined distance from each other, typically 3.5 inches (about 90 millimeters), which corresponds to the standard button spacing on men's shirts. Each button slit 12 and 14 is adapted to receive and be held by buttons located on the shirt of the wearer. See FIG. 7, buttons 18 and 19.

Figure 2:
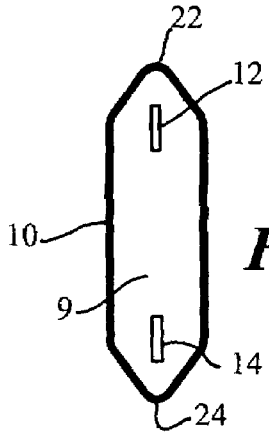
FIG. 2 is a plan view showing the bottom of the same placket.

FIG. 2 is a plan view showing the bottom side of the same placket shown in FIG. 1. One of several advantages of the invention is that the placket can have one color, texture or pattern on the top side and a different one on the bottom side. The wearer can thus adapt or mix-and-match placket colors to either minimize the presence of the placket or utilize the placket as a decorative item.

Figure 3:
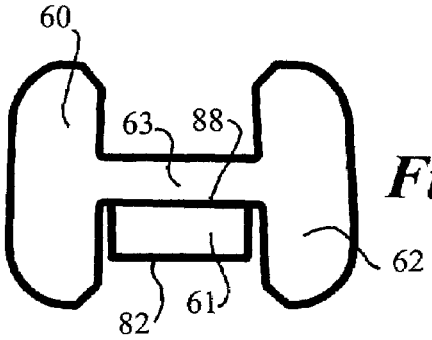
FIG. 3 is a plan view of the H as it appears when it is steel rule die cut.

FIG. 3 is a plan view of the H as it appears after it is steel rule die cut. FIG. 3 is of the side of the material having a coating of adhesive. Typically, a hot melt or pressure sensitive adhesive is applied to one side of a fabric before steel rule die cutting. One of several advantages of the present invention is that a carrier sheet, such as wax paper, can accompany the fabric through the steel rule die cutting process, and thereafter carry the H shapes until they are applied to neckties. FIG. 3 shows a shape after the cutting process and before a folding and selective heating/pressing step. Surfaces 61, 62, 63, and 64 have hot melt or pressure sensitive-like adhesive. As part of the steel rule die cutting, it is preferable, but not mandatory, that the die also embosses a fold line 88 so that flap 82 can more easily and accurately be folded over onto surface 63.

Figure 4:
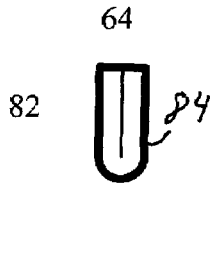
FIG. 4 is a sectional view of the cross bar shown in FIG. 5.
Figure 5:
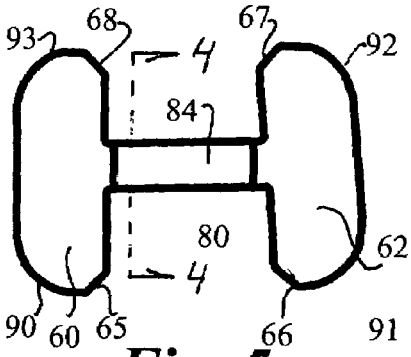
FIG. 5 is a plan view showing the adhesive side of the H, with the cross bar 80 formed by the fold shown in FIG. 4.

FIG. 4 is a cross section A-A' taken through the folded cross bar 80, shown in FIG. 5. Only the cross bar is shown. Because the material can be paper, leather, plastic film, or whatever, no hatching is shown in FIG. 4. The adhesive surfaces 61 and 63 have been pressed together to form double thick glue line 64. Typically, the glue is then activated by a hot pressing step which selectively applies heat to the folded material encompassing surfaces 61 and 63. No heat is applied to surfaces 62, and 60.

Figure 7:
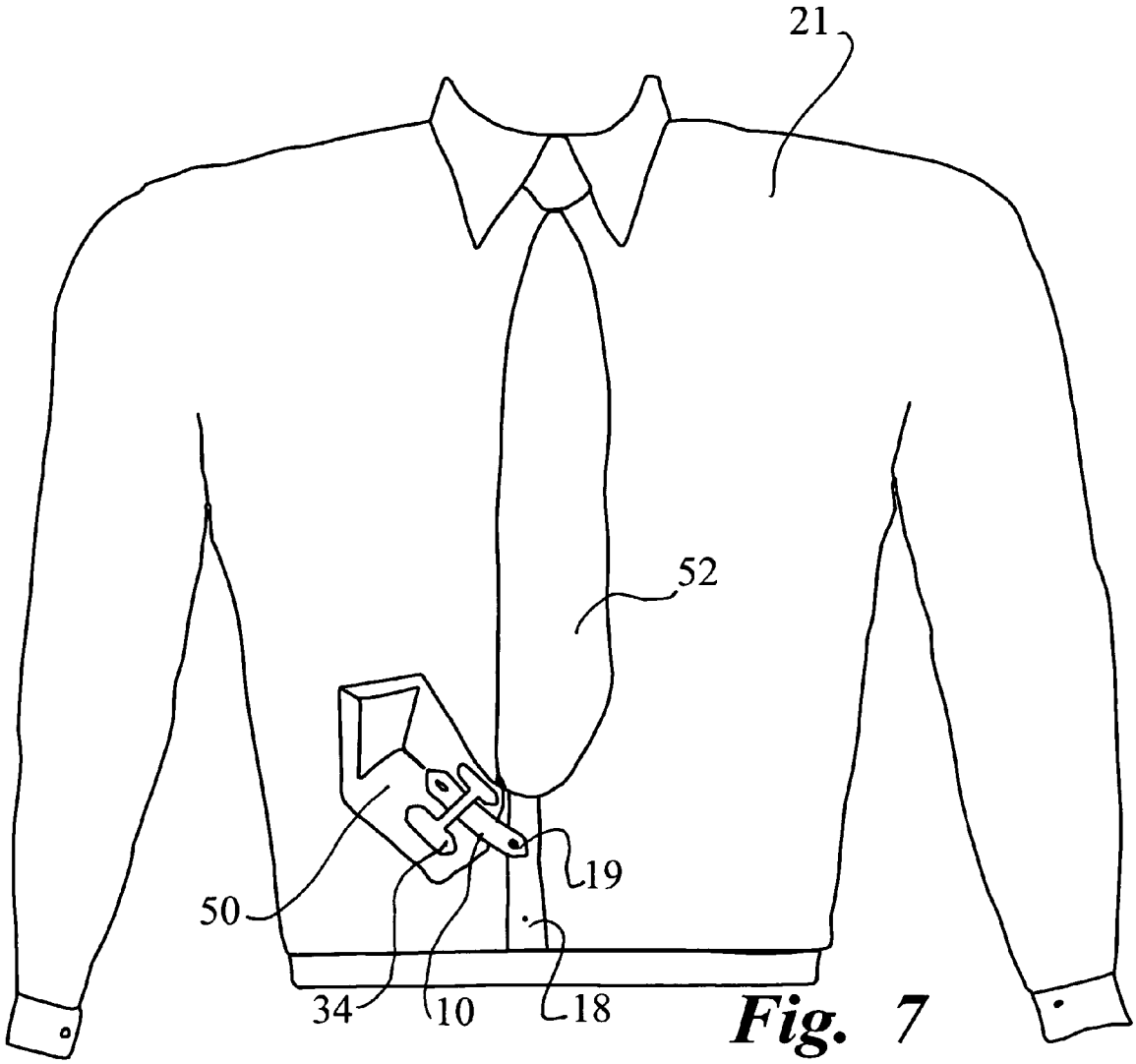
FIG. 7 is an perspective view showing the invention as used with a typical shirt or blouse 21, a typical tie 52, the H 34, the placket 10, and shirt buttons 18 and 19.
Figure 8:
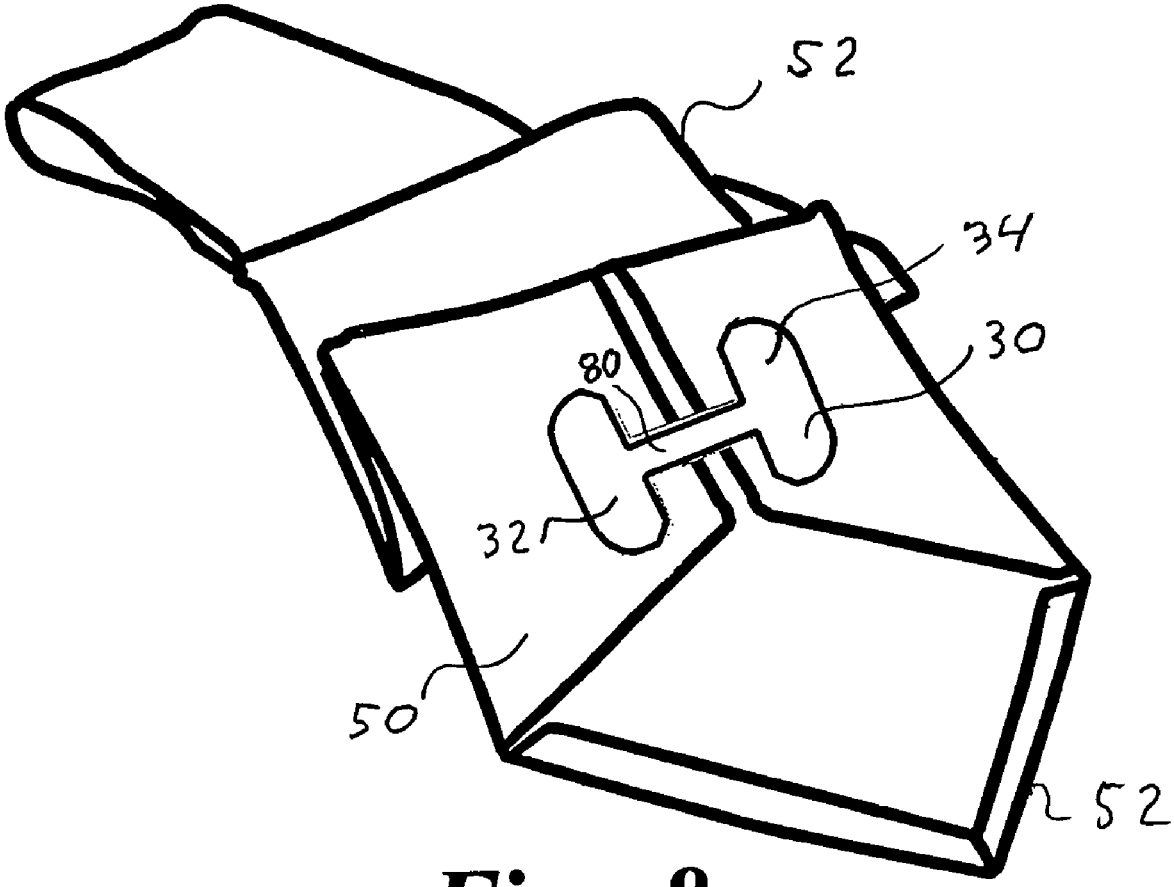
FIG. 8 is a perspective view showing the back side of the apron of the necktie and the preferred position of the H as mounted on that back side.

FIG. 5 shows the H as in its finished state. Adhesive surfaces 60 and 62 are now available to be bonded to the back of the apron of the necktie, as shown in FIGS. 7 and 8. Yet, non-adhesive surface 84 has a relatively smooth surface which permits low-friction, easy sliding of placket 10. In the preferred embodiment, the legs of the H have chamfers 65, 66, 67, and 68. These serve to guide the placket 10 as it slides under the cross bar 80. Again, in the preferred embodiment, Filets 90, 91, 92, and 93 serve to distribute the sheer force and tensile forces applied to the back side of the apron of the necktie, in order to avoid stress concentration and wrinkling of the tie.

Figure 6:
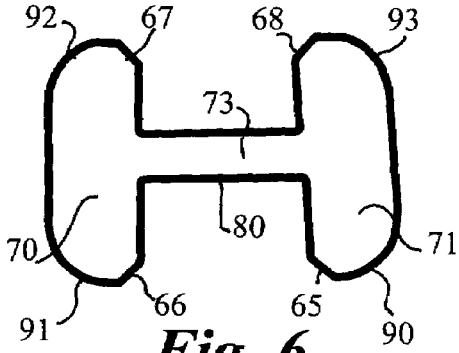
FIG. 6 is a plan view of the "top side" of the H.

FIG. 6 shows the H of FIG. 5 flipped over to reveal smooth, non-adhesive surfaces 70, 71 and 73.

FIG. 7 is an elevation showing the invention as used with a typical shirt or blouse 21 and a typical tie 52. The H 34 is mounted on the back of the tie apron. The placket 10 is first attached to a shirt button 19 and then threaded under the cross bar 80 and then attached to another shirt button 18. There is no necessary limitation to using adjacent buttons. Thus a first and a third or fourth button on the shirt could be used. Nor is there a necessity that only two button slits be present in the placket. More than two button slits could allow for a wide variety of button spacing on shirts and blouses.

FIG. 8 is a perspective view of the H 34 mounted on the back of the apron of a necktie. The legs 30, 32 of the H 34 are mounted on the back 50 of the apron of the necktie 52 by placing the H as shown on the tie. After positioning the H, the necktie is laid on a flat surface, such as an ironing board, with the apron of the necktie facing down on the ironing board and the back of the necktie facing up, towards the hot iron. The iron is preheated at "wool" level which typically yields 200 F. (95 C) or more. The preferred position of the H is at the portion of the necktie near the end of the apron and just above the belt line of the wearer. Placing the glossy adhesive side of the legs of the H downwards toward the back of the necktie, the iron is held on the H for about 40 seconds. The H is allowed to cool. The adhesive has now firmly bonded the H to the back 50 of the apron 52. The placket slidably secures the end of the tie having the H to the placket, and in turn, securing the tie to stay near the shirt.

While the embodiment of the invention shown and described is fully capable of achieving the results desired, it is to be understood that this embodiment has been shown and described for purposes of illustration only and not for purposes of limitation.

What is claimed is:

1. A necktie retaining means for use by a wearer of a shirt having spaced buttons near the center front of the shirt, and a necktie mounted in a collar around the wearer's neck comprising, in combination:

a First Part, called a placket, cut from flat material, the flat material has an upper side and a lower side, each side of the placket having a smooth, low friction finish with no adhesive, said placket has a longitudinal axis between a first end and a second end, the distance between the two ends is a pre-determined length and the typical length is 4¾ inches (about 116 millimeters), the placket has a predetermined width, typically 1 3/16 inches (about 28 millimeters), the placket has at least two button slits aligned substantially on the longitudinal axis, the button slits are spaced at a pre-determined distance from each other, typically 3.5 inches (about 90 millimeters), which corresponds to the standard button spacing on men's shirts, each button slit is adapted to receive and be held by buttons located on the shirt of the wearer, and the second part of the invention is a modified H shape, having two vertical legs and a cross bar connecting the vertical legs of the H shape, the material forming the modified H shape has an upper side and a lower side, the upper side has a relatively low friction finish with no adhesive, the lower side of the material has a coating of heat activated adhesive glue, said glue typically is activated by heating to 180 F (about 90 C.), said H shape is cut from flat material such that enough material remains near the cross bar so that the material forming the cross-bar can be folded over on itself to double the thickness of the cross bar, after folding the adhesive side of the cross bar onto itself to double the thickness, the cross-bar has a bond which has been selectively hot ironed to activate the glue between upper and lower sides of the cross bar, the horizontal bar in the H shape, as folded and hot ironed, functions as a miniature cantilever box beam between the legs of the H shape, and the horizontal bar of the H shaped cross-piece spans a predetermined distance between the inner edges of the legs of the H, said predetermined distance is at least 1.05 times the width of the placket described above, thus assuring that the placket may freely slide between the horizontal bar and the surface of the necktie.

2. The necktie restraining device of claim 1 wherein the H shape is applied to the back of the apron of the neck tie near the end of the necktie nearest the belt line of the wearer.

3. The necktie restraining device of claim 1 wherein the legs of the H shape have chamfered edges to guide the placket and avoid binding of the placket.

4. The necktie restraining device of claim 1 wherein the legs have fillets formed on the outside of the legs to help evenly distribute the forces to avoid abrupt changes in contour or texture of the apron of the necktie.

* * * * *